US007156075B2

(12) United States Patent
Kiessling

(10) Patent No.: US 7,156,075 B2
(45) Date of Patent: Jan. 2, 2007

(54) IGNITION METHOD WITH STOP SWITCH FOR INTERNAL-COMBUSTION ENGINES

(75) Inventor: Leo Kiessling, Cadolzburg (DE)

(73) Assignee: Prufrex-Elektro-Apparatebau, INH. Helga Muller geb Dutschke, Cadolzburg (DE)

( * ) Notice: Subject to any disclaimer, the term of this patent is extended or adjusted under 35 U.S.C. 154(b) by 0 days.

(21) Appl. No.: 11/201,529

(22) Filed: Aug. 11, 2005

(65) Prior Publication Data

US 2006/0191518 A1 Aug. 31, 2006

(30) Foreign Application Priority Data

Aug. 20, 2004 (EP) ..... 04019782
Dec. 7, 2004 (DE) ..... 10 2004 059 070

(51) Int. Cl.
*F02P 5/00* (2006.01)
*F02P 3/06* (2006.01)

(52) U.S. Cl. ..... 123/406.56; 123/596

(58) Field of Classification Search ..... 123/406.56, 123/406.57, 596, 599
See application file for complete search history.

(56) References Cited

U.S. PATENT DOCUMENTS 4,553,511 A * 11/1985 Hayakawa et al. ..... 123/179.3
5,730,098 A * 3/1998 Sasaki et al. ..... 123/198 DB
6,629,520 B1 * 10/2003 Inagaki et al. ..... 123/618
6,694,959 B1 * 2/2004 Miwa et al. ..... 123/637
6,701,896 B1 * 3/2004 Kiessling ..... 123/406.57
6,895,933 B1 * 5/2005 Miwa et al. ..... 123/406.47

* cited by examiner

*Primary Examiner*—John T. Kwon
(74) *Attorney, Agent, or Firm*—Frank H. Foster; Kremblas, Foster, Phillips & Pollick

(57) ABSTRACT

For stopping an internal combustion engine, a stop switch prevents the triggering of the ignition. A controller in the ignition circuit determines the state of the stop switch by evaluating signals on the state of the internal combustion engine, corresponding information data is generated, and a corresponding stop flag is set and/or enabled. Depending on this information, the activation of the ignition switch, that controls ignition spark, is either blocked or enabled by the controller.

15 Claims, 3 Drawing Sheets

Flow chart for stop-button function. Detail on the resetting of the flag OFF to ON through software during motor run-down (during rotation down to standstill).
This routine is executed by the software in each rotation, after the rotational direction and rpm have been detected.

IGNITION METHOD WITH STOP SWITCH FOR INTERNAL-COMBUSTION ENGINES

CROSS-REFERENCES TO RELATED APPLICATIONS

This application claims the benefit of Foreign Applications EP 04 019 782.4, filed Aug. 20, 2004 and DE 10 2004 059 070.2, filed Dec. 7, 2004.

(b) CROSS-REFERENCES TO RELATED APPLICATIONS

This application claims the benefit of Foreign Applications EP 04 019 782.4, filed Aug. 20, 2004 and DE 10 2004 059 070.2, filed Dec. 7, 2004.

(c) STATEMENT REGARDING FEDERALLY-SPONSORED RESEARCH AND DEVELOPMENT (Not Applicable)

(d) REFERENCE TO AN APPENDIX (Not Applicable)

BACKGROUND OF THE INVENTION

1. Field of the Invention

The invention relates to an ignition method for internal-combustion engines, a magnetic ignition module, and also an arrangement for performing the ignition method.

2. Description of the Related Art

In the operation of internal-combustion engines, especially low-power engines, high demands are placed on the efficiency of the ignition systems, so that existing exhaust and noise emission guidelines, as well as application-specific safety regulations, are satisfied.

German Patent Application Nos. DE 197 36 032 A1 and DE 102 01 422 A1 of the applicant describe respectively an ignition method and an ignition arrangement for internal-combustion engines or an electronic, rpm-dependent control and a diagnosis method for internal-combustion engines. Both of the mentioned applications mainly deal with the somewhat stationary, continuous operating state of internal-combustion engines, but give only a few clues on advantageous configurations of the disclosed methods and/or devices with reference to the start and stop phase when the internal-combustion engines are operating.

A known problem in the start and stop phase, which can grow to a temporary complete failure of the internal-combustion engine, is the erroneous operation of the internal-combustion engine in a restart, i.e., starting immediately after the internal-combustion engine is stopped. A stop phase of the internal-combustion engine is commonly triggered by the activation of an automatically locking stop switch. Now, if the user forgets, before the restart, to deactivate the stop switch, this leads to "flooding" of the internal-combustion engine, so that it can no longer be started for a long time.

DE 200 14 502 U1 describes a capacitor ignition system, wherein, through a short activation of a stop switch, by means of an extra flip-flop with additional circuitry, the gate-cathode path of a thyristor is short-circuited, and the thyristor is moved from a switch operating state into a non-switching stop state, so that an ignition spark is no longer generated. Because the stalling of the engine is a safety function, the stop switch state is also held after stopping the engine for a certain time by the set flip-flop until a capacitor (reference symbol 46) allocated to the flip-flop power supply has discharged via a resistor. The resulting and also prolonged waiting time due to the recharging of the capacitor up to the end of the stop state is also strongly dependent on tolerances due to the manufacturing tolerances of electrical and electronic components of the capacitor ignition system, such as the capacitance and/or manufacturing tolerance of capacitors, so that for the design of the capacitor ignition system, the desired waiting time must be selected to be long for safety reasons.

Thus, a disadvantage in the proposed device is that immediate restart of the engine after stoppage is not possible, which means a waiting period for the operator.

The problem of the present invention is to propose robust, flexible, and economical alternatives for an ignition method, a magnetic ignition module, and also an arrangement for performing the ignition method.

BRIEF SUMMARY OF THE INVENTION

This problem is solved by an ignition method according to Claim 1, by a magnetic ignition module according to Claim 5, and also an arrangement for performing the method according to Claim 19.

The method according to Claim 1 relates to an ignition method, especially the generation of an ignition spark, for internal-combustion engines, preferably low-power engines, especially outboard motors and/or motors of motor-operated gardening equipment and/or motor-operated leisure and sports equipment.

In such internal-combustion engines, ignition systems, especially capacitor ignition systems, are preferably used for generating the ignition spark necessary for the combustion of fuel. The ignition systems preferably have one or more coils interacting with a magnet wheel of the internal-combustion engine equipped with permanent magnets for generating a charging voltage, especially an alternating charging voltage, wherein the magnet wheel rotates during the operation of the internal-combustion engine and induces the charging voltage in the coil or coils. Furthermore, the ignition system preferably has an energy storage element for storing the energy generated by induction through the interaction of the magnet wheel and coils, and also an ignition switch, which, controlled by a controller, releases the energy stored in the energy storage element for the purpose of generating an ignition spark.

For the method according to the invention, there is an energy storage element, especially a capacitor, which is charged by an alternating charging voltage generated using a magnetic generator. The magnetic generator can include a pole shoe locked in rotation with a rotating motor shaft of the internal-combustion engine with permanent magnets, which induces a voltage in one or more charging coils and thus generates the alternating charging voltage. The amplitude and the time profile of the alternating charging voltage can be directly dependent on the similarly time-dependent machine rotational position based on the type of generation. Alternatively or additionally, the alternating charging voltage can be smoothed and/or rectified.

The charged energy storage element is discharged by an ignition switch activated synchronously with the alternating charging voltage for triggering the ignition. To activate the ignition switch, a controller is used, which is preferably embodied as a programmable and/or microelectronic controller, especially as a CPU, microcontroller, DSP unit, and/or ASIC. For example, the model 16F628 microcontroller from Microchip Technology Inc. can be used. The ignition switch is activated as a function of the state of the internal-combustion engine, for example, as a function of signals with reference to their rotational position and/or rpm. The synchronous discharge and advantageous implementations are disclosed explicitly in the already mentioned DE 197 36 032 A1 and DE 102 01 422 A1 by the applicant and the entire disclosure of these documents is herewith integrated into the present application by means of reference.

For stopping the motor, there is a stop switch element, a stop switch, or a stop button, with which the triggering of the ignition is prevented or can be prevented. Such a stop switch element preferably has the effect that the alternating charging voltage or at least a relevant part of the alternating charging voltage, which is used especially for charging the energy element, is short-circuited to ground either directly or via one or more switching elements, such as thyristors. Alternatively, the ignition voltage can also be grounded with or without the intermediate connection of other switching elements.

For the method according to the invention, it is further provided that in the controller, the state of the stop switch element is determined by evaluating signals on the state of the internal-combustion engine, corresponding information data is generated, and, in particular, a corresponding stop flag is set and/or enabled. Depending on this information, the activation of the ignition switch is either blocked or enabled by the controller.

The mentioned signals on the state of the internal-combustion engine can be signals which are derived from a charging voltage, especially the alternating charging voltage, and especially information on the rpm and/or rotational position of the internal-combustion engine and/or of the magnet wheel carried by the internal-combustion engine. Alternatively or additionally, there can be sensors which directly measure information on the state of the internal-combustion engine. For other embodiments, signals from the ignition system are used as signals on the state of the internal-combustion engine.

The signals on the state of the internal-combustion engine are evaluated, the evaluation being tailored to the exceeding or falling below of set thresholds and/or the fulfillment of fixed conditions and/or fuzzy-logic methods and/or neural networks are used. Based on the result of the evaluation, the state of the stop switch element can be determined, i.e., the state of the stop switch element is presumed to be opened or switched.

Depending on the presumed state of the stop switch element, a state variable, especially a stop flag, is set and/or enabled according to advantageous, optional training. The stop flag is preferably formed as an assignable digital memory location either in internal memory of a microcontroller or as an external memory unit, such as, e.g., a latching flip-flop.

In a preferred embodiment of the method, the prevention of the ignition by means of the stop switch element is realized by hardware devices, preferably independent of the controller. Preferably, the stop switch element directly short-circuits the charging voltage and/or ignition voltage, or prevents the charging voltage and/or ignition voltage, in particular, from being applied to the switch contacts of the stop switch element by, for instance, switching them to ground. This embodiment can exhibit the advantage that self-cleaning effects occur on the STOP switch element through the short-circuiting of high charging voltages. A configuration of the invention wherein there is no direct signal path leading from the stop switch (STOP) to the controller (MC, U8), especially a microprocessor, corresponds to this embodiment. Thus, without the interaction of the microprocessor or controller, the stop switch, especially the stop switch element, can intervene in elements of the high-current or power part of the ignition system according to the invention for suppressing the ignition spark.

In an advantageous refinement of the method, an OFF value is allocated to the stop flag or the other state variables when the stop switch element is activated and an ON value is allocated to the stop flag before or at restart of the machine or its run-down. The set OFF value has the effect that an operating state of the ignition system is assumed, especially one controlled by the controller, in which no ignition spark is generated or discharged. The set ON value has the effect that an operating state of the ignition system, especially one controlled by the controller, is assumed in which ignition sparks are generated and/or discharged. Thus, the prevention of the triggering of the ignition can be implemented both directly by the stop switch element and also by the controller. In particular, the prevention of ignition is caused first by the switching of the stop switch element and is then continued and/or performed parallel in time by the controller. Thus, preferably a stop button method is performed, wherein, through a short activation of the stop switch element, especially the stop button, the motor is turned off until stopped, wherein flag information on the stop button activation is stored, for example, in the form of an OFF value, and before restart, it is reset to an ON value.

The problem forming the basis of the invention is further solved by a magnetic ignition module for low-power motors according to Claim 5.

The magnetic ignition module is preferably used in the method according to one of Claims 1–4 in connection with low-power motors. The low-power motors can be internal-combustion engines, as already described, in particular, the low-power motors can have a generator device, which includes a magnet wheel or the like, to which coil devices of the ignition module are allocated.

The magnetic ignition module has a controller and a stop switch. The controller can be formed as already explained in connection with the method. As the stop switch, preferably a non-latching switching device is used, which automatically returns to the open switching state after the switching device is closed. Alternatively, a switching device can be used which returns and/or is reset to the open switching state after the switching device is closed controlled by the controller. Preferably, a stop switch is used, to which the charging voltage generated by the generator device is applied directly or can be placed onto the switch contacts.

According to the invention, the controller is constructed to recognize the state of the stop switch from the change of signals in the ignition system of the magnetic ignition module or of the entire ignition system including the magnet wheel/magnetic generator. The signals can be signals generated in the ignition system or passed through it. In particular, the signals can be signals on the state of the low-power motor or internal-combustion engine which have already been described in connection with the method according to the invention.

The training for recognizing the state of the stop switch from the change of signals in the ignition system can be implemented in software as a program in the controller. The program includes, in particular, routines for one or more threshold comparisons, digital signal processing routines, fuzzy-logic routines, routines for neural networks, and/or regulators, especially with constant, variable, or adaptive transfer functions.

In a preferred refinement of the magnetic ignition module, the controller includes a stop flag which can assume the value ON or OFF. The assignment of the stop flag is realized on the basis of the evaluation of signals on the low-power motor state and/or signals of the ignition system, with which the state of the stop switch can be determined. The stop flag can be set as an assigned or assignable memory location in a controller-internal, especially microprocessor-internal, read/write/working memory as 1-bit information, wherein preferably a set bit, thus a bit value equal to one, is allocated to the OFF operating state for safety reasons.

In one refinement of the device, the information on the OFF operating state is not stored in a single bit, but instead it is coded and/or stored as a pattern in several bits or bytes and thus a redundant information pattern and/or an error-correcting code is used. Because the turning off of a motor concerns a safety function, through this refinement, an improvement of the behavior in terms of electromagnetic compatibility (EMV) can be achieved.

Furthermore, there can be means which are formed such that the activation of the ignition switch is blocked for the OFF flag value and the activation of the ignition switch is enabled for the ON flag value. The means can be formed especially as a trigger device of a switching element, preferably a thyristor.

In one preferred refinement of the magnetic ignition module, the controller is formed in terms of circuitry and/or programming such that the OFF flag stop value is first stored and/or set when the activation of the stop switch is determined for more than one motor rotation. This configuration represents a safety measure against undesired setting of the stop flag and thus against undesired switching off of the low-power motor, which can be caused, for example, by an unintentionally short activation of the stop switch or by electrical noise. Preferably, the activation of the stop switch must be determined for a number of motor rotations dependent on the rpm before the stop flag value is set to OFF. The information on this rpm-dependent limit can be stored in a preferably non-volatile memory, e.g., as a table. For example, it can be determined that below 2000 RPM (revolutions per minute) the activation must be determined for more than one motor rotation, up to 10,000 RPM the activation must be determined for more than two motor rotations, and above 14,000 RPM it must be determined for more than 4 rotations.

In a preferred refinement of the magnetic ignition module, one or more signal lines are provided which connect the controller to signal sources, generate signals in terms of the state of the low-power engine and/or the ignition system and transmit the signals. Through the signal lines, in particular, signals are supplied to the controller regarding the rotational position and/or rpm of the rotating magnet wheel of the low-power motor and/or the low-power motor or regarding the coil voltage, especially the charging voltage or the alternating charging voltage.

In a preferred embodiment of the magnetic ignition module, the controller is formed in terms of circuitry and/or programming such that, after recognition of a strong reduction of the amplitude of the coil voltage signals, the stop flag is set from an ON value to an OFF value. Preferably, the magnetic ignition module is formed such that the charging voltage is short-circuited when the stop switch is activated and the charging voltage and/or coil voltage signals, which are derived from the charging coil, are strongly reduced, so that no signal or only a signal with correspondingly low energy, which is preferably received by an A/D converter of the controller, is fed to the controller. When a level reduction of the signal, especially of more than 50%, preferably more than 90%, is recognized, the stop flag is switched from an ON value to an OFF value. Alternatively, the magnetic ignition module can also be connected such that the controller receives a pulse as a signal as soon as the energy storage device, especially the capacitor, has been discharged for generating an ignition spark. If there is no pulse, the stop flag is switched from an ON value to an OFF value. As another alternative, the stop switch can short-circuit the signal applied to the controller, especially the coil voltage signal, and if there is no signal, the stop flag is changed accordingly.

In one advantageous refinement of the magnetic ignition module, the controller is formed in terms of circuitry and/or programming such that the stop flag is switched from an OFF value to an ON value after one or more of the following conditions occurs:

Condition 1: The low-power motor falls below a minimum rpm (n_ON).

The rpm can be measured by evaluating the rpm-dependent charging voltage and/or coil voltage signals.

Condition 2: The low-power motor falls below a minimum angular velocity.

The minimum angular velocity is calculated, for example, by measuring the time that the motor requires to move from one angle marking to a next angle marking. Such a measurement method is disclosed in DE 102 32 756 A1, and the corresponding contents of disclosure are taken over into the present application by means of reference.

Condition 3: Recognition of too small a decrease in rpm or recognition of an increase in rpm.

The rpm can be measured by evaluating the rpm-dependent charging voltage and/or coil voltage signals. A decrease and/or increase in rpm is determined by comparing the rpm of a just completed rotation, i.e., the rotation U(n), with the rpm of a rotation completed previously U(n-x) and calculating an rpm difference. Preferably, for 2-stroke motors, the comparison compares the rpm of the last, immediately preceding rotation, thus U(n-1), and for 4-stroke motors, the comparison compares the rpm of the rotation before the last rotation, thus U(n-2). As soon as—for example, when the operator pulls on a starter rope of the low-power motor during the motor run-out—a decrease in rpm that is less than a preset difference limit is determined by means of the rpm difference, and/or as soon as there is an increase in rpm, condition 3 is fulfilled. The difference limits are preferably stored as a function of the rpm in a preferably non-volatile memory, especially in a table, wherein, in particular, lower difference limits are stored for higher rpm values than for lower rpm values.

Condition 4: Appearance of a reverse in rotational direction and/or stopping oscillation.

This condition appears as soon as reverse running of the low-power motor is set through a reverse in rotational direction. A reverse in rotational direction can occur during run-down of the low-power motor if the motor can no longer surpass the upper dead center (OT) due to the compression in the cylinder of the low-power motor and oscillates backwards.

Preferably, the stop flag is set from the OFF value to the ON value only when one or more of the above-mentioned conditions is present for more than two successive rotations of the low-power motor.

In one preferred embodiment, the controller is constructed in terms of circuitry and/or programming such that the switching of the stop flag from the OFF value to the ON value is enabled only as soon as the motor falls below a certain motor rpm (n_min_ON). If the motor has a drive clutch, this rpm threshold is preferably placed so that the drive clutch is open, thus, e.g., at a value less than 4500 RPM and/or, for example, less than an engaged rpm. Below the engaged rpm, it is guaranteed that an optional mechanical load is decoupled at the output shaft of the motor (or start-up for the tool) and thus no longer affects the changes in the motor rpm (affects should only come from the motor and the starter device). Preferably, the rpm threshold lies further below the rpm that can be achieved by the starter device of the low-power motor.

If the motor has a drive clutch, this rpm threshold is preferably set such that the drive clutch is open, thus, at a value less than 4500 RPM, for instance. Preferably, the rpm threshold also lies below the rpm that can be achieved by the starter device of the low-power motor. The maximum rpm achieved by the user with the starter device, is, e.g., around 2500 RPM.

In one advantageous refinement of the magnetic ignition module, the controller is constructed in terms of circuitry and/or programming especially such that the stop flag is set from an OFF value to an ON value due to the initialization of the controller, caused by a POWER ON RESET. In this design, the stop flag is held in a defined manner at the OFF value until the supply voltage of the controller has fallen below the minimum voltage for powering the read/write/working memory (RAM). Preferably, the magnetic ignition module is constructed such that in this state, either the charging voltage is too low to generate an ignition spark and/or the controller has a LOW VOLTAGE RESET function, which has the effect that no trigger pulse is output to activate the ignition switch and/or the triggering of the ignition is prevented, thus blocked. When the low-power motor is restarted, through the increase of the supply voltage, the POWER ON RESET function is activated, which sets the stop flag to the ON value for subsequent initialization of the controller. Preferably, a discharge path can be provided for a storage capacitor, which guarantees the supply voltage of the controller, in order to narrow the total time tolerance for reaching the LOW VOLTAGE RESET state in a defined way.

A preferred configuration of the magnetic ignition module is provided if no direct signal path leads from the stop switch to the controller. This can be the case, for example, when the ignition switch and/or the switching element can be triggered in parallel by the stop switch and the controller to short-circuit the charging voltage.

The problem forming the basis of the invention is further solved by an arrangement according to Claim 19, wherein the arrangement preferably has a magnetic ignition module with one or more of the features of Claims 5–18 and is formed especially for performing the method according to one of Claims 1–4.

An advantageous refinement of the method according to one of Claims 1–3 is provided, when a magnetic ignition module according to one or more of Claims 4–18 is used and/or an arrangement according to Claim 19 is used.

With the invention, a series of advantages can be achieved:

The restart of the internal-combustion engine is simplified and accelerated and, in particular, it is possible immediately after and/or even during the motor run-down. For the stop switch, previously common standard configurations can be used, which can also be exposed to current contact loads with self-cleaning effects, in that they are used for short-circuiting the same signals as in the state of the art. Additional hardware expense is eliminated (cost advantage). Because the stop switch function according to the invention can be realized essentially by means of software, ignition control hardware known, for example, from DE 102 02 422 can be reused with essentially no changes. The adaptation to the single added stop switch can be realized substantially by changing the internal (program) flow in the switching equipment.

The following is a summary: the invention relates to an ignition method for internal-combustion engines and also to an arrangement for performing the ignition method. A known problem in the start and stop phase, which can extend to a temporary complete shutdown of the internal-combustion engine, is the operating error of the internal-combustion engine during a restart, i.e., starting directly after the internal-combustion engine is stopped. Usually, a stop phase of the internal-combustion engine is triggered by activating a locking stop switch. Now, if the user forgets to deactivate the stop switch before the restart, this leads to a "flooding" of the internal-combustion engine, so that for a certain time period, it can no longer be started. To solve this problem, a magnetic ignition module, an ignition method, and also an arrangement are proposed, wherein the magnetic ignition module includes a controller and a stop switch and the controller is formed in terms of circuitry and/or programming for identifying the state of the stop switch from the changing of signals in the ignition system of the magnetic ignition module.

BRIEF DESCRIPTION OF THE SEVERAL VIEWS OF THE DRAWINGS

Additional details, features, feature combinations, and advantages are explained on the basis of the invention with reference to the following embodiments. Shown are:

FIG. 2 is used.

DETAILED DESCRIPTION OF THE INVENTION

Figure 1:
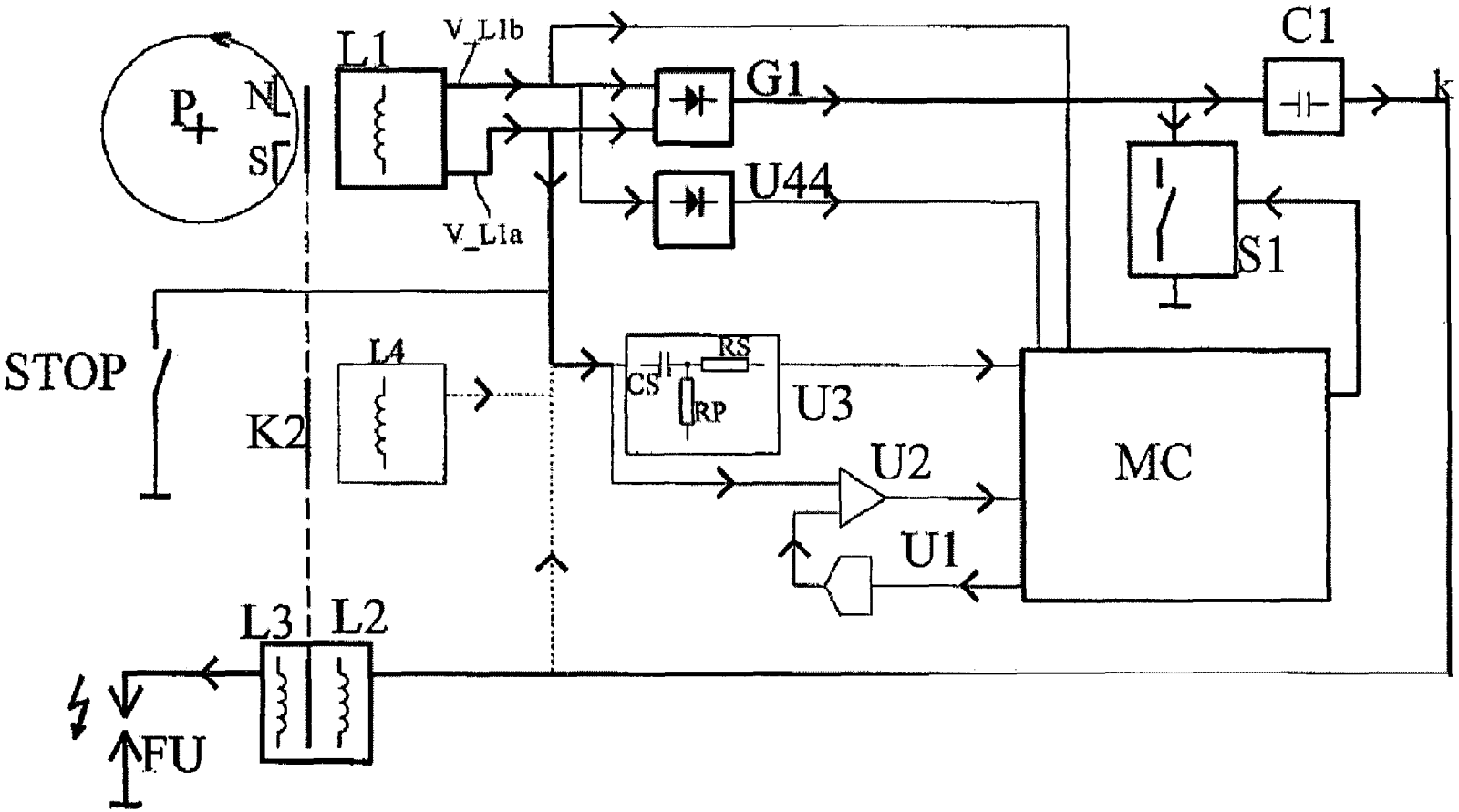
FIG. 1: a block diagram of a first embodiment of a magnetic ignition module according to the invention.

The block diagram in FIG. 1 is described up to the stop switch STOP in DE 102 01 422 A1, whose contents of disclosure are incorporated entirely in the present application by means of reference.

In a schematic representation, FIG. 1 shows a magnet wheel P with permanent magnets N, S in the top left region. During the operation of a motor, not shown, the magnet wheel rotates and induces a charging voltage V_L1 in a charging coil L1. The charging voltage is led via a bridge rectifier G1 to an ignition capacitor C1. The ignition capacitor C1 is used for storing ignition energy for generating an ignition spark and is charged up to a capacitor voltage.

The ignition capacitor C1 is discharged by closing a switch element S1, which is controlled by a programmable, electronic controller MC, for example, a microcontroller. After the switch element is closed, the ignition capacitor is discharged via a primary coil L2 of an ignition transformer L3, L2. Due to a winding ratio of the secondary coil L3 to the primary coil L2 of approximately 100, an amplitude of a few thousand volts can be achieved on the secondary coil L3 of the ignition transformer L2, L3, whereby a spark discharge occurs at the spark path FU of a spark plug for igniting the fuel mixture in the combustion chamber of the internal-combustion engine.

As already discussed, the switching element S1, for example, a thyristor, is activated by the microcontroller MC as the electronic controller. It is supplied with power from a second rectifier U44, which is powered by the charging coil L1 just like the rectifier G1 mentioned above.

The microcontroller receives information on the rotational position of the crankshaft or the magnet wheel P of the internal-combustion engine from the alternating voltage V_L1 of the charging coil L1 via corresponding terminals V_L1*a*, V_L1*b*. By means of the magnet wheel P moving past the charging coil L1, a cycle of three half-waves I, II and III is produced. The first half-wave I and the third half-wave III of positive polarity on one hand and the second half-wave II of negative polarity on the other hand are furnished as separate signals V_L1*a* and V_L1*b*, respectively, on separate terminals. The half-wave II is supplied to the microcontroller as a signal V_L1*b* optionally via an interface circuit for its synchronization with the magnet wheel rotations.

The other signal, V_L1*a*, yielding the half-waves I and III of positive polarity, is supplied to the microcontroller indirectly via an RC difference element U3 with the passive components CS, RS, RP. Through the difference-forming effect, a computer program running in the microcontroller MC can react to extreme positions or peak points of the alternating voltage V_L1 and extract information on the times or angular positions T3, T2, where the peak values or amplitudes of the alternating voltage half-waves I, III occur. The approximately rectangular output signal V_diff is generated at the inputs of the microcontroller allocated to the difference element through the connection of the output terminals of the difference element U3 to internal clamping diodes of the microcontroller. For ignition systems with flatter signal amplitudes, it can be useful to connect active signal generators, e.g., a transistor stage in a common emitter circuit configuration, downstream of the difference element U3 and then to supply the output signal of this emitter follower to the microcontroller MC.

According to FIG. 1, the microcontroller MC is still connected externally to an analog-digital converter U2, U1, whose input is connected directly to the output terminal of the output terminal or the alternating voltage signal V_L1*a*. The converter can be realized with known weighting methods, that is, a comparator U2 compares the alternating voltage tapped at the coil L1 to the output voltage of a digital-analog converter U1, whose digital input value is set incrementally by an output interface of the microcontroller until the measured value is reached, which is signaled to the microcontroller MC by the output of the comparator U2.

In FIG. 1, dashed lines further show that the power supply and/or the coil signals to be processed can be tapped by other coils, which surround the iron core K2. For example, the alternating voltage half-waves I, II, III are derived from the primary coil L2 or an auxiliary coil L4 (shown with dotted lines in FIG. 1). The power supply circuit U4 and (not shown) coupling voltage dividers are matched to the corresponding level.

In order to stop a motor operated in connection with the magnetic ignition module shown in FIG. 1, there is a stop switch STOP, which is formed, e.g., as a button. If the button STOP is closed, then the charging voltage V_L1 applied to the coil L1 is short-circuited to ground, whereby the charging voltage V_L1, but at least the voltage V_L1*a*, breaks down. As a consequence of the voltage breakdown, the signal from the RC difference element U3 also assumes the voltage value 0 V relative to ground. The signal applied to the analog-digital converter U2, U1 also breaks down to the voltage value 0 V relative to ground. Thus, the microcontroller MC can only receive voltage signals with the value 0 V relative to ground at its inputs. A routine of the software running in the microcontroller MC determines from the reception of the zero voltage signals that the stop switch STOP has been closed and that the user intends to shut down the motor. In a next step, the microcontroller MC sets a stop flag in its internal memory from an ON value to an OFF value. As a consequence of the switching of the stop flag, the triggering of the ignition switch S1 is prevented by the microcontroller MC, so that the motor runs down due to the lack of ignition sparking. A method realized in this magnetic ignition module for resetting the stop flag from the OFF value to the ON value is explained with reference to FIG. 3.

In a preferred embodiment of the magnetic ignition module in FIG. 1, the power supply of the microcontroller has an energy storage element, so that the supply voltage for the microcontroller MC does not break down immediately when the stop switch STOP is activated.

Figure 2:
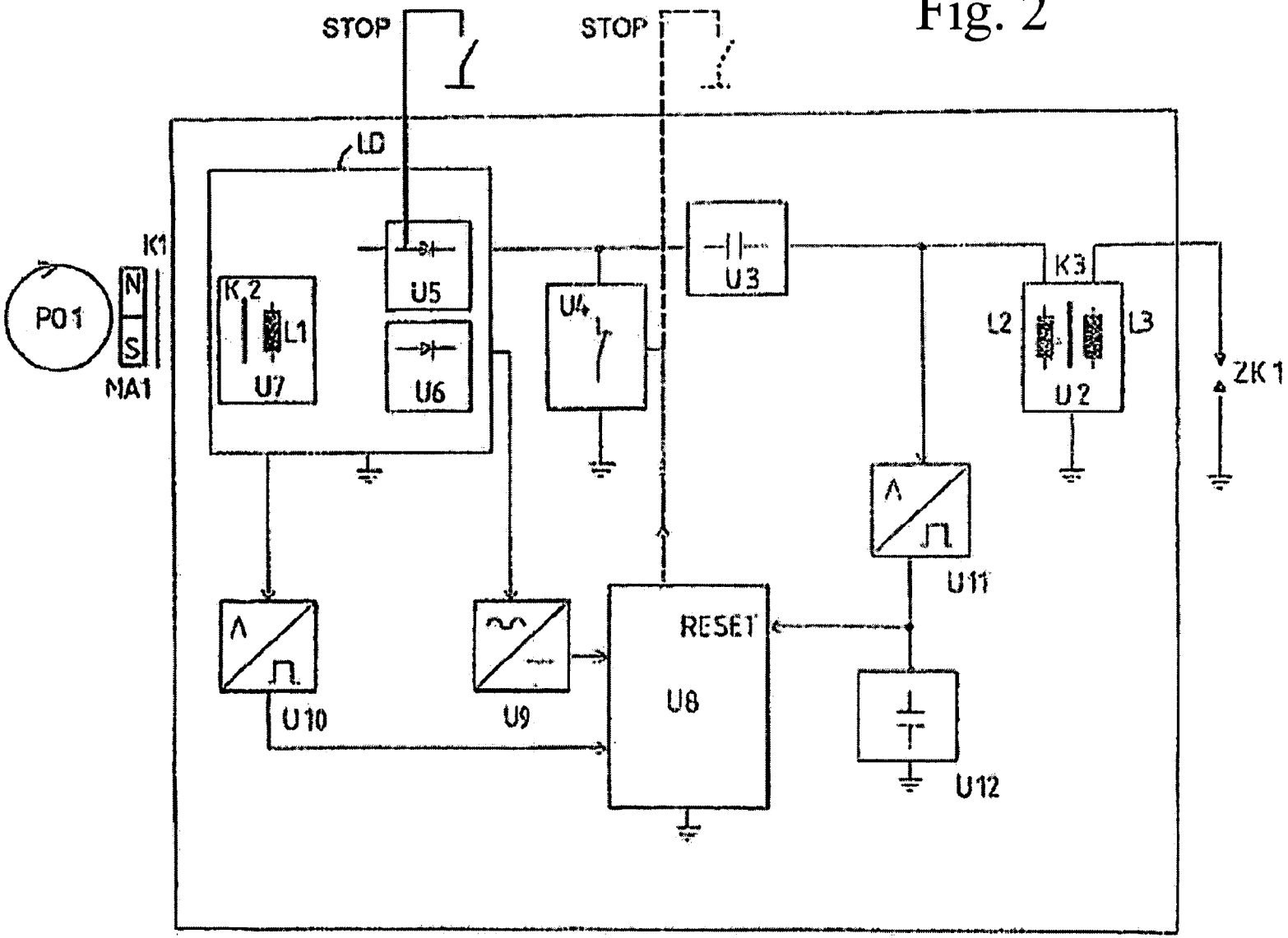
FIG. 2: a block diagram of a second embodiment of a magnetic ignition module according to the invention.

FIG. 2 shows the block circuit diagram of another embodiment of a magnetic ignition module. Significant regions of the block circuit diagram shown in FIG. 2 are described in DE 197 36 032 A1 by the applicant. The disclosure in this document is incorporated entirely; it is integrated into the present application by means of this reference.

In the magnetic ignition module in FIG. 2, analogous to the magnetic ignition module in FIG. 1, a voltage, especially a charging voltage, is induced in a coil set U7 which has at least one coil L1, by means of a magnet wheel P01, which carries a permanent magnet N, S and a pole shoe K1. The induced voltage or a part thereof is applied to an ignition capacitor U3 via a first rectifier U5 and charges this capacitor to an ignition voltage or high voltage UC.

The ignition capacitor U3 is discharged analogously to the way in the magnetic ignition module in FIG. 1. In a difference with the magnetic ignition module in FIG. 1, other control and voltage signals are fed to the microcontroller U8 in FIG. 2 as explained below:

A first signal line leads from the charging part LD, which includes the coil set U7 and the rectifier U5 and U6, to a preferably analog signal input of the microcontroller U8, wherein a pulse transformation stage U10 is connected in series in the signal line. The induced alternating voltages of the charging coil set U7, especially the charging coil L1, are fed into the first signal line. The level of the alternating voltage is matched by means of a pulse transformer U10. Information on the time-dependent angular position of the magnet wheel, the rpm, the rotational direction, and the instantaneous angular velocity can be gained via the time profile of the matched signals through a programming routine in the microcontroller U8. For other designs for deriving the mentioned information, refer to DE 197 36 032 A1 by the applicant, in which other variants of the circuitry are also disclosed.

In parallel with the first signal line, a supply line leads from the charging coil set U7, especially from the rectifier U6, via a filter element U9, in which the pulsing DC voltage originating from the rectifier U6 is buffered, smoothed, and limited, to the microcontroller U8. Thus, the microcontroller U8 is powered via the supply line.

A second signal line taps the voltage between the ignition capacitor U3 and ignition coil U2 and leads the tapped signal via another pulse transformer to a RESET input of the microcontroller. The pulse transformer U11 is formed such that a RESET signal is generated as a consequence of the ignition switch U3 and lasts until the end of the ignition sparking. Through a delay element U12, the RESET signal can be lengthened. The RESET signal is used to set the outputs and inputs of the microcontroller to a defined state for each triggering of the ignition switch and to hold these states during the period of the ignition sparking. At the end of the RESET signal, the microcontroller U8 is reinitialized, which guarantees that the microcontroller operates reliably in a defined way for the activities before the next rotation and thus any noise has no effect on the following rotations.

For turning off the motor, alternatively there are stop switches at two different positions:

A first stop switch switches the charging voltage of the charging coil L1 or at least a significant portion thereof to ground (earth ground). As a consequence, a matched signal is not forwarded to the microcontroller U8 via the first signal line, but instead only ground is applied to the corresponding input, thus a constant 0 V signal. Due to the lack of any signal amplitude, a routine in the programming of the microcontroller can infer that the stop switch has been activated and the user would like to stop the motor. After this determination, a stop flag is set from an ON value to an OFF value, with the consequence that the triggering of the ignition switch U4 is prevented and no ignition spark is generated even if the stop switch is opened, as long as the stop flag is set to the OFF value. Alternatively, the microcontroller can also be programmed so that the activation of the stop switch is inferred from the lack of the RESET signal at an expected time.

Alternatively, a second stop switch STOP (shown with dashed lines) can be provided, which is connected so that in the activated state of the stop switch STOP, the triggering signal of the ignition switch U4, which is generated by the microcontroller U8, is set to ground. In this embodiment, the triggering of the ignition switch is prevented by the stop switch, with the consequence that no additional ignition sparking can be generated. In this embodiment, the activation of the stop switch can be inferred from the lack of the RESET signal. Here, the trigger pulse to the switch U4 is prevented by the STOP button shown with dashed lines. Thus, the ignition capacitor is definitely charged, but not discharged, thus the ignition voltage is prevented (not short-circuited).

A method realized in this magnetic ignition module for resetting the stop flag from the OFF value to the ON value is explained with reference to FIG. 3.

Figure 3:
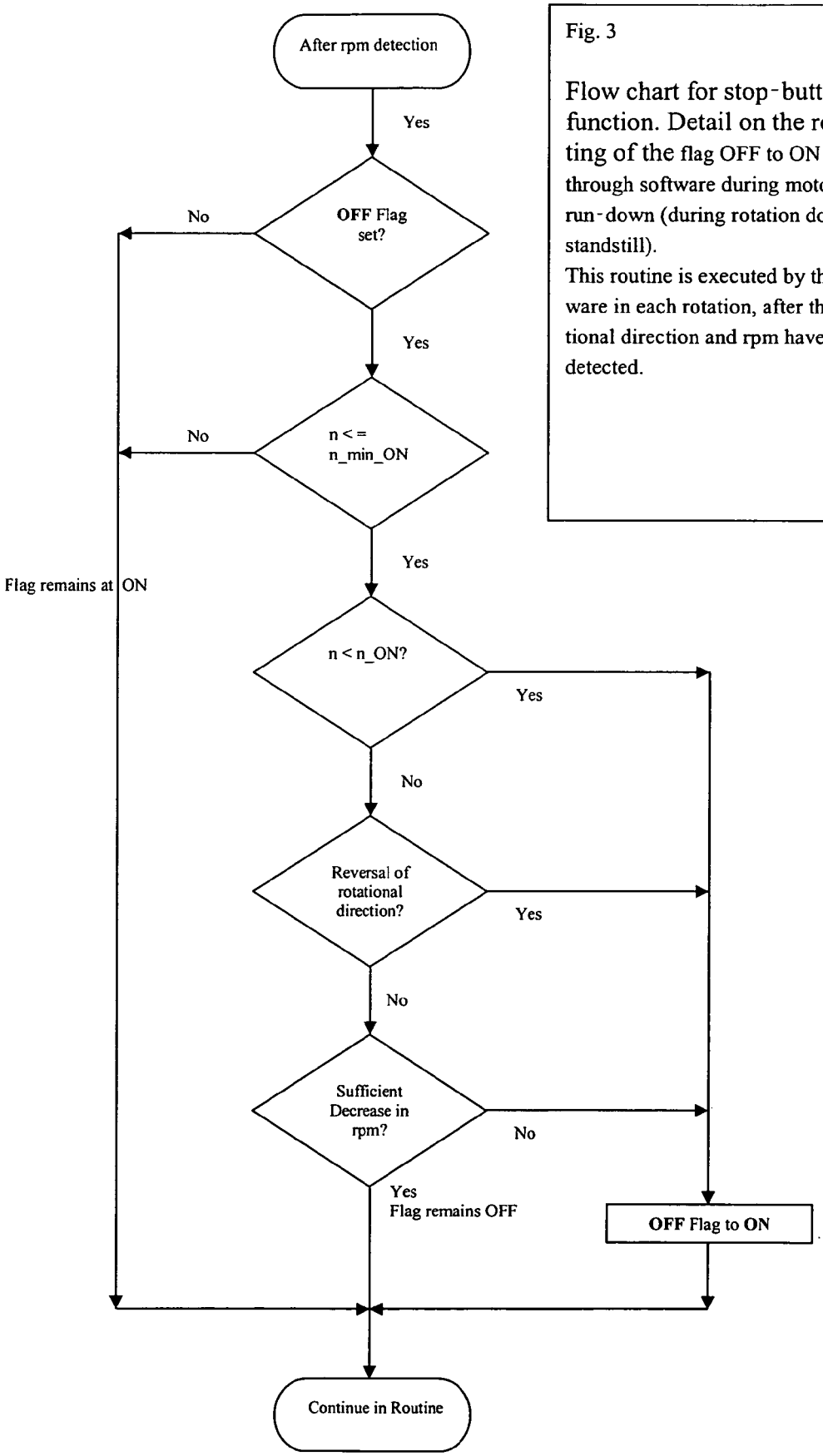
FIG. 3: a flow chart for an embodiment of the method according to the invention, in which a magnetic ignition module from FIG. 1

FIG. 3 shows a flow chart for an embodiment of the method according to the invention, in which a magnetic ignition module from FIG. 1 or FIG. 2 is used. The method shown in the flow chart is preferably performed during and/or after each rotation of the motor.

In one step, the rotational direction and the rpm of the motor or of the magnet wheel locked in rotation with the shaft, especially the crankshaft, of the motor, is detected.

A first query identifies whether the stop flag has an ON value or an OFF value. If an ON value is set, this value is held and the flow chart is executed again at the next rotation of the motor.

If the OFF value is set, a second query identifies whether the rpm lies under a certain limit n_min_ON. The value n_min ON defines the limit, starting at which, in terms of software, the stop flag may be switched from an OFF value to an ON value and represent a safety query. The limit n_min_ON can be stored as a parameter in a memory of the microcontroller. With regards to a suitable magnitude for the value n_min_ON, refer to the above description of the invention.

If the actual rpm is greater than or equal to the limit n_min_ON, the OFF value is held for the stop flag and the flow chart is executed again at the next rotation of the motor. If the actual rpm lies below the limit n_min_ON, additional queries are performed:

A first query tests whether the actual rpm lies below a second rpm limit n_ON. This query should enable a restart to be allowed at a sufficiently small rpm.

A second query tests whether the rotational direction has been reversed. A reverse in rotational direction occurs especially when the motor "stops oscillating," i.e., when the motor no longer turns past the top dead center during run-out.

A third query tests whether the rpm has decreased sufficiently. An insufficient decrease in rpm occurs especially when the user attempts to restart the motor by pulling the starter cable during the run-down of the motor. In this case, the decrease in rpm is reduced or even causes an increase in rpm.

If only one of the three queries is answered with "Yes," then the stop flag is switched from the OFF value to the ON value and thus early restart of the motor is enabled. If all three queries are no, the stop flag is held at the OFF value and the flow chart is executed again at the next rotation of the motor.

LIST OF REFERENCE SYMBOLS

STOP Stop switch
P Magnet wheel
N, S Permanent magnet
V_L1 Charging voltage
L1 Charging coil
G1 Bridge rectifier
C1 Ignition capacitor
UC Capacitor voltage
S1 Switch element
MC Controller
L2 Primary coil
L3, L2 Ignition transformers
L3 Secondary coil
FU Spark path
U44 Second rectifier
G1 First rectifier
V_L1*a*, V_L1*b* Terminals
I, II, III Half-waves
U3 RC difference component
CS, RS, RP Passive components
T3, T2 Times, angle positions
V_diff Output signal
U2, U1 Analog-digital converter
K2 Iron core
L4 Auxiliary coil
O V Voltage value
P01 Magnet wheel
K1 Pole shoe
U7 Coil set
U5 Rectifier
U8 Microcontroller
LD Charging part
U10 Pulse shaper stage
U6 Rectifier U9 Filter element
U11 Pulse shaper
U12 Delay element
n_min_ON Value

The invention claimed is:

1. A magnetic ignition module for a low-power motor or some other internal-combustion engine driving a magnetic wheel (P,P01) or some other magnet generator, with one or more coils (L1–L4), in which voltages including a charging voltage (V_L1*a*,V_L1*b*) for an ignition energy storage element (C1,U3) are able to be induced by the magnet wheel (P,P01) or the magnet generator, with a controller (MC,U8) sampling the voltages (V_L1*a*,V_L1*b*), for activating an ignition switch (S1,U4) discharging the energy storage element (C1,U3) via an ignition transformer (L2,L3), and with a stop switch or stop button or stop switch element—referred to collectively below as stop switch (STOP)—which is embodied and arranged for preventing the ignition triggering or build-up, characterized in that the controller (MC,U8) is designed in terms of circuitry and/or programming to identify the state of the stop switch (STOP) from the changing of signals in the ignition system of the magnetic ignition module and to block or enable the activation of the ignition switch (S1,U4) as a function of this state.

2. A magnetic ignition module according to claim 1, characterized in that, in the controller (MC,U8), there is a stop flag that can assume the values ON or OFF, and that the controller (MC,U8) is designed in terms of circuitry and/or programming such that the stop flag is set and/or guided on the basis of an evaluation of signals on the engine state, with which the state of the stop switch is determined.

3. A magnetic ignition module according to claim 1 or 2, characterized in that the stop flag are able to be set to the value ON or the value OFF, wherein, in the ON state, the activation of the ignition switch (S1,U4) is able to be enabled and in the OFF state, the activation of the ignition switch (S1,U4) is disabled.

4. A magnetic ignition module according to claim 1 or 2, characterized in that the controller is designed in terms of circuitry and/or programming such that the stop value first stores the value OFF or is set to this value when the activation of the stop switch (STOP) is determined for more than one motor rotation.

5. A magnetic ignition module according to claim 1 or 2, characterized in that there are one or more signal lines for transmitting signals to the controller (MC,U8) on the rotational position and rpm of the rotating magnet wheel (P01) of the low-power motor and/or of the low-power motor itself, for transmitting coil voltage signals (V_L1*a*,V_L1*b*), which are derived from voltages induced in the coils (L1–L4) by the rotating magnet wheel (P01), and/or that in the controller (MC,U8) there is a detection of rpm and rotational direction.

6. A magnetic ignition module according to claim 5, characterized in that the controller (MC,U8) is designed in terms of circuitry and/or programming such that in case of a strong reduction of the amplitude of the coil voltage signals, preferably a reduction by more than 50%, the stop flag is set from an ON value to an OFF value to block the activation of the ignition switch (S1,U4).

7. A magnetic ignition module according to claim 1, characterized in that the controller (MC,U8) is designed in terms of circuitry and/or programming such that after identifying that the low-power motor has fallen below a minimum rpm (n_ON) and/or has fallen below a minimum angular velocity, the stop flag is set from an OFF value to an ON value to enable the activation of the ignition switch (S1,U4).

8. A magnetic ignition module according to claim 1, characterized in that the controller (MC,U8) is designed in terms of circuitry and/or programming such that after identifying the run-down or restart of the low-power motor by the controller (MC,U8) the stop flag is set from an OFF value to an ON value.

9. A magnetic ignition module according to claim 1, characterized in that the controller (MC,U8) is embodied in terms of circuitry and/or programming such that, when a limit for the decrease in rpm is not met or when an increase in rpm is identified by the controller, the stop flag is set from an OFF value to an ON value to enable the activation of the ignition switch (S1,U4), wherein the value of the limit for the decrease in rpm or the increase in rpm is preferably a function of the rpm and/or is defined by means of a stored table.

10. A magnetic ignition module according to claim 1, characterized in that the controller (MC,U8) is designed in terms of circuitry and/or programming such that when an rpm reversal is identified by the controller, the stop flag is set from an OFF value to an ON value to enable the activation of the ignition switch (S1,U4).

11. A magnetic ignition module according to claim 1, characterized in that the controller (MC,U8) is designed in terms of circuitry and/or programming such that through the initialization of the controller, caused by a POWER ON RESET function of the controller, the stop flag is set from an OFF value to an ON value for enabling the activation of the ignition switch (S1,U4).

12. A magnetic ignition module according to claim 1, characterized in that the triggering of the STOP function is controlled by means of the stop switch (STOP), independent of the microcontroller or some other controller (MC,U8), in that the switch output is connected directly to power components and/or high-current components or elements (V_L1*a*;U4;U5) for suppressing the ignition sparking (FU).

13. A magnetic ignition module according to claim 1, characterized in that there is a memory in the controller (MC,U8), for storing the operating state or the value of the state variable or the stop flag (ON/OFF).

14. A magnetic ignition including a magnet generator (P,P01), which induces rpm-dependent alternating voltages and in this way charges an energy storage element (U3,C1), and with a programmable controller (U8,MC) sampling the alternating voltages to activate an ignition switch (U4) discharging the energy storage element (U3,C1) via the primary coil (L2) of an ignition transformer (U2), and with a stop switch element (STOP), for preventing the ignition triggering, characterized in that in the controller (MC,U8) there is a functional module that is designed to identify and follow the state of the stop switch element (STOP) and which analyzes and updates state information, including one or more flags, on the stop switch element, and the controller (MC,U8) is designed in terms of circuitry and/or programming in order to block or enable the activation of the ignition switch (S1,U4) as a function of the state information.

15. A magnetic ignition according to claim 14, characterized in that the functional module is designed to calculate and/or derive the state information from signal changes in the magnetic ignition module.

* * * * *

UNITED STATES PATENT AND TRADEMARK OFFICE

CERTIFICATE OF CORRECTION

PATENT NO. : 7,156,075 B2
APPLICATION NO. : 11/201529
DATED : January 2, 2007
INVENTOR(S) : Leo Kiessling It is certified that error appears in the above-identified patent and that said Letters Patent is hereby corrected as shown below:

In claim 6, line 60 of column 13, cancel the text "preferably a reduction by more than 50%".

Signed and Sealed this

Seventh Day of August, 2007

JON W. DUDAS
*Director of the United States Patent and Trademark Office*